US007500273B2

(12) United States Patent
Dana

(10) Patent No.: US 7,500,273 B2
(45) Date of Patent: Mar. 10, 2009

(54) SINGLE STRAP OVERALLS

(75) Inventor: Jon Dana, Richmond, MO (US)

(73) Assignee: USI Clothing, LLC, Blue Springs, MO (US)

( * ) Notice: Subject to any disclaimer, the term of this patent is extended or adjusted under 35 U.S.C. 154(b) by 136 days.

(21) Appl. No.: 11/272,181

(22) Filed: Nov. 10, 2005

(65) Prior Publication Data

US 2007/0118959 A1 May 31, 2007

(51) Int. Cl.
*A41D 13/02* (2006.01)

(52) U.S. Cl. ..... 2/79; 2/227; 2/51

(58) Field of Classification Search ..... 2/79, 2/311, 104, 227, 459, 460, 48, 51, 94, 305, 2/914

See application file for complete search history.

(56) References Cited

U.S. PATENT DOCUMENTS

| | | | | | |
|---|---|---|---|---|---|
| 791,676 | A | * | 6/1905 | Dodshon | 2/227 |
| 900,050 | A | * | 9/1908 | Wise | 2/79 |
| 1,191,288 | A | * | 7/1916 | De Voist | 2/79 |
| 1,225,732 | A | * | 5/1917 | Edelman | 2/227 |
| 1,613,516 | A | * | 1/1927 | Johannesen | 2/271 |
| RE17,047 | E | * | 7/1928 | Mahan | 2/230 |
| 1,789,784 | A | * | 1/1931 | Sneider | 2/227 |
| D92,183 | S | * | 5/1934 | Krosney | D2/731 |
| 2,016,897 | A | * | 10/1935 | Garrett et al. | 2/227 |
| 2,132,668 | A | * | 10/1938 | Wittmack | 2/227 |
| 2,344,845 | A | * | 3/1944 | Baldeschwieler | 2/48 |
| 2,492,499 | A | * | 12/1949 | Pollock | 2/227 |
| 3,206,767 | A | * | 9/1965 | Meisberger | 2/333 |
| 3,638,334 | A | * | 2/1972 | Malikowski | 434/260 |
| 4,459,705 | A | * | 7/1984 | Langford | 2/105 |
| D298,480 | S | * | 11/1988 | Bornstein | D2/743 |
| 5,211,321 | A | * | 5/1993 | Rodriguez | 224/604 |
| 5,901,374 | A | * | 5/1999 | Foster | 2/82 |
| 6,839,907 | B2 | * | 1/2005 | Katz | 2/48 |

* cited by examiner

*Primary Examiner*—Gary L Welch
*Assistant Examiner*—Alissa J Tompkins
(74) *Attorney, Agent, or Firm*—Husch Blackwell Sanders LLP

(57) ABSTRACT

The present invention relates generally to an improved single strap overall. More particularly, the invention relates to an overall garment with a single strap design that remains fastened better than previous double strap overalls. The invention improvements also include a novel portable electronic device, such as a cell phone, holder positioned on the front panel of the overalls for easy and convenient access to the phone in a compartment that retains the phone during bending and quick movements by the user.

10 Claims, 2 Drawing Sheets

SINGLE STRAP OVERALLS

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Overalls have clothed people at work or play since the 1700s. Overalls have been worn by railroad engineers, college students, hippies, farmers, mechanics, painters, children, and rap music artists. Overalls, once the exclusive purview of the lower classes in the $18^{th}$ century, were one of the first types of clothing to be mass-produced. The color of the overalls produced were significant with painters and plasterers wearing white, farmers wearing blue or brown, railway workers sporting pinstripes, and blue denim being a favorite among mechanics.

Traditional bib overalls, however, have always been problematic for laborers of any kind. One of the failings with regard to the typical pair of bib overalls is that, during physical work involving a great deal of movement, one of the shoulder straps easily slips off. This provides a source of irritation to the wearer. Further, because these straps tend to slide off, they do not provide a suitable support means for pants, as well as for items such as cell phones that may be present in pockets. Simply put, the common article of clothing known as a bib overall, has long suffered from the above drawbacks.

Improvements in clothing comprise many different types of features. Simple ornamental improvements are noted in U.S. Pat. No. 4,975,987 to Teachout et al., in which customized fabric receiving strips are shown and described. Variations on the invention in Teachout include additional receiving loops as well as additional means to attach an ornament to a garment. The use of straps in conjunction with clothing to provide a superior garment is also shown in U.S. Pat. No. 6,256,789 to Young et al., in which a clothing article and safety harness are combined together to form an improved overall garment. The usage of straps to support pants has also seen recent improvements. In U.S. Pat. No. 6,698,031 to Lewis, a pair of pants was provided with a plurality of horizontal slots, through which supports straps were able to pass through the slots and able to be secured to the appropriate length. In place of slots, loops were also provided which functioned similarly to the slots. Despite these improvements, a need in the art still exists for a bib overall that reduces the slippage of the shoulder straps from the shoulder of the wearer as well as provide secure support for portable electronic devices, such as cell phones, for the convenience of the wearer.

SUMMARY OF THE INVENTION

The present invention is directed to a modified pair of overalls to be worn over one shoulder in which a triangular front portion is provided with a strap attachment means, and where an offset back strap portion engages the backside of the overalls, with the strap end portion able to be positioned over the user's shoulder and secured to the strength attachment means, and adjustable as to length, so as to conform with the particular body size of the wearer.

The front portion is provided with a portable electronic device pocket, with the pocket opening having a strap means that is able to be secured across the opening of the pocket. This strap has the capability of securing a portable electronic device within the pocket. In addition, the adjustable waist of this invention defines a strap that is secured at one end to the waistband of the pants portion of this invention. The other end of the strap passes through a belt loop, with the strap end been secured along its length to itself. If the adjustable strap is pulled tightly through the loop before being secured, it will have the effect of moving the loop toward the strap secured end portion and thus diminishing the overall circumference of the pants around the wearer.

BRIEF DESCRIPTION OF THE SEVERAL VIEWS OF THE DRAWING

In the accompanying drawings which form a part of the specification and which are to be read in conjunction therewith and in which like reference numerals are used to indicate like parts in the various views.

DETAILED DESCRIPTION OF THE INVENTION

Figure 1:
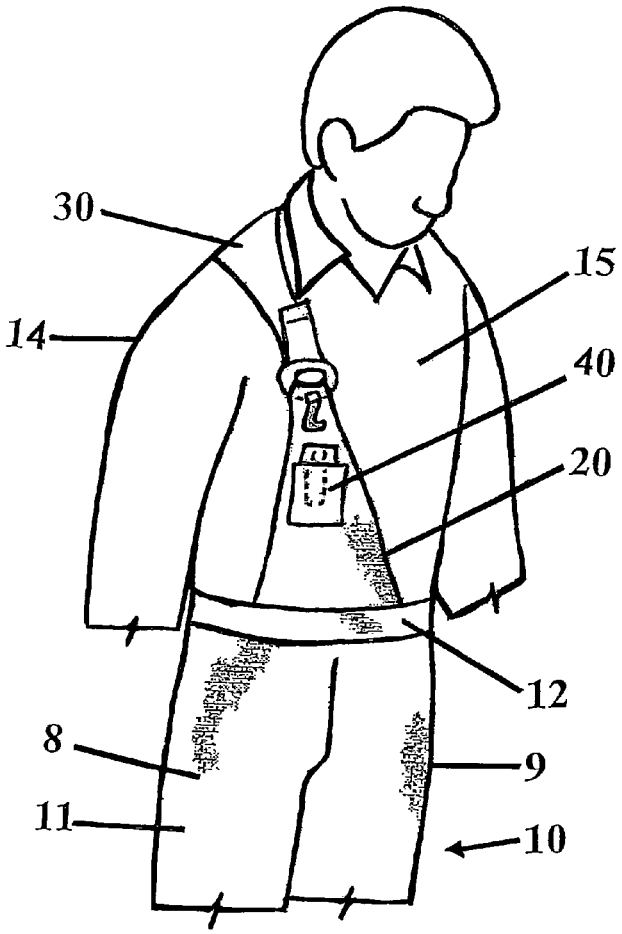
FIG. 1 is a front perspective view of the improved single strap overalls as they would appear when being worn.
Figure 2:
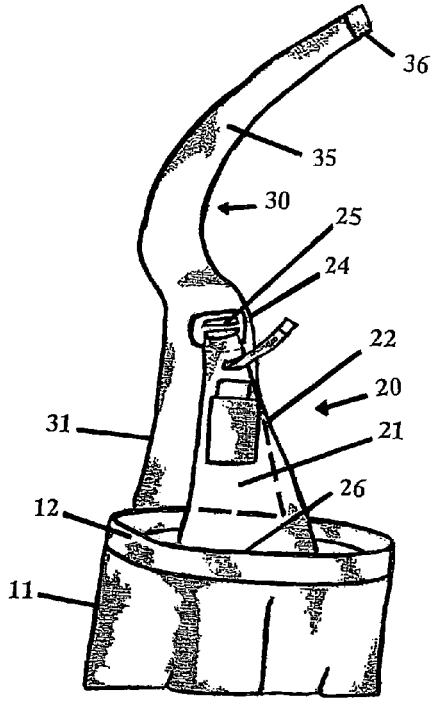
FIG. 2 is a front elevational view of the improved single strap overalls, depicting the front panel outer side and back panel inner side, showing the relative positions of the panels to the waistband and to each other.

Referring now to FIGS. 1 and 2, the improved single strap overalls 10 of the present invention are made of any material suitable for use in clothing. In one embodiment, the overalls 10 are formed from denim or canvas or other durable material but may also be formed of less durable and more fashionable material depending upon the needs of the wearer. Overalls 10 include a pant portion 11, a front panel 20 and a back panel 30. Pant portion 11 includes a waistband 12 and two pant legs 8 and 9, similar to known overall pant legs. Waistband 12 is coupled to a top portion of pant legs 8 and 9 and encircles the user's waist. The height of waistband 12 may vary depending upon the needs and size of the wearer. In a preferred embodiment, waistband 12 is from about 1-3 inches high and, more preferably, about two inches high. Waistband 12 may be made of the same or different material as overalls 10. In a preferred embodiment, waistband 12 also contains elastic to better conform to the user's shape and help hold pants portion 11 to the user's waist.

Figure 3:
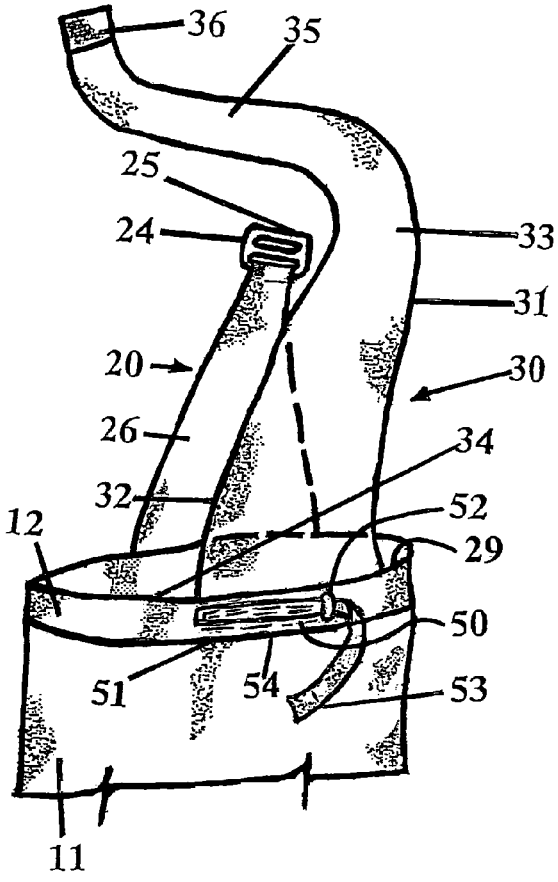
FIG. 3 is a rear elevational view of the improved single strap overalls, depicting the back panel outer side, and front panel inner side, showing the relative positions of the panels to the waistband and to each other, and also showing the waist cincher.

Waistband 12 may also includes a waist cincher 50 to further conform waistband 12 to the user's shape and keep pants portion 11 in place. As waist cincher 50 is tightened, the waistband 12 becomes smaller and the single strap overalls 10 fit the user more snuggly. Waist cincher 50 includes a fastener 54 to selectively tighten or loosen waist cincher 50 based on the user's comfort and needs. Fastener 54 may include, but is not limited to, buckles, snaps, buttons, zippers, hook and eye fasteners, or any other fastening mechanism that allows waist cincher 50 to be selectively adjusted and positioned. Referring now to FIG. 3, one preferred embodiment of waist cincher 50 is shown as a single strip of fabric having a first end 51 fixedly affixed to the rear of waistband 12 and a free second end 53 with a loop 52 fixedly attached to waistband 12 at a generally center portion of waist cincher 50 between first and second ends 51 and 53 such second end 53 may be threaded through loop 52. In one embodiment, the hook portion of a hook and loop fastener is fixedly attached to first end 51 and its mating loop portion it fixedly attached to second 53 for mating engagement with first end 51. It will be appreciated by those skilled in the art that either portion of a hook and loop fastener may be affixed to first end 51 so long as its mating portion is affixed to second end 53. Second end 53 is threaded through loop 52 and folded over to matingly engage or fasten with first end 51. To tighten waist cincher 50, a greater portion of waist cincher 50 proximate second end 53 is pulled through the loop 52 and fastened to first end 51.

Referring now to FIGS. 2 and 3, front and back panels 20 and 30 of overalls 10 are substantially triangular in shape, with the top of back panel 30 terminating in a strap 35 and the top of front panel 20 terminating in a strap fastener 24. Front and back panels 20 and 30 may be made of any material including, but not limited to denim, canvas, cotton, polyester, and the like, and do not have to match either the other panel or pants portion 11. As shown in FIG. 3, back panel 30 forms a triangle with three edges including an angled edge 32, a vertical edge 33, and a bottom edge 29. Bottom edge 29 connects to waistband 12 at belt line 34. The top of back panel 30 forms a strap 35 that extends over the user's shoulder 14. In one embodiment, the length of strap 35 should be long enough to accommodate a variety of torso lengths and chest widths. Strap 35 may include a fastener 36 at its terminal end. Preferred fasteners include, but are not limited to, buckles, snaps, buttons, zippers, hook and eye fasteners, or any other fastening mechanism suitable for use in overalls 10. In one embodiment, fastener 36 may be a mating pair of hook and loop fasteners fixedly attached proximate the terminal end of strap 35, one on either surface of strap 35.

Referring now to FIG. 1, vertical edge 33 will be placed on the same side of the user's body as the shoulder strap 35 is worn over. For example, on an overall worn over the left shoulder, vertical edge 33 will be on the left side of the back panel 30. Angled edge 32 will begin slightly right of the middle back of waistband 12 and slant across the back to the left shoulder. In one embodiment, back panel 30 does not cover both sides of the user's lower back and does not extend to the user's sides along the belt line 34. In a preferred embodiment, front panel 20 forms an offset triangle, with the top tip positioned not above the center of the waistband but off to one side to cross over the user's shoulder 14. Overall 10 may be crafted to fit over either the left or right shoulder.

Figure 4:
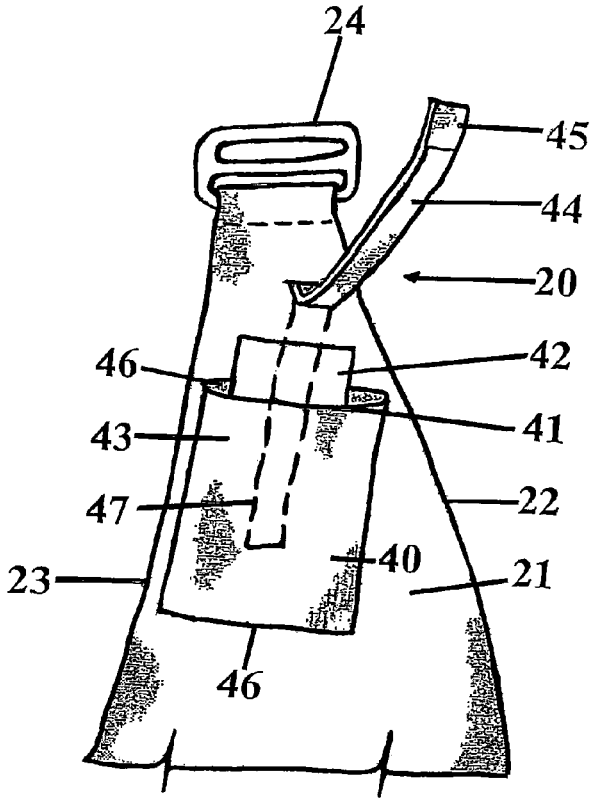
FIG. 4 is an enlarged view of the portable electronic device pocket and also showing the restraining strap both in the open and closed position.

As shown in FIG. 4, front panel 20 is coupled to waistband 12 in the front of overalls 10 at belt line 34. Like back panel 30, front panel 20 forms a triangle with the three sides including a front angled edge 22, a front vertical edge 23, and a front bottom edge 26. In one embodiment, front panel 20 extends only across the front portion of the user, although it could also stretch around the side of the user. The top of front panel 20 terminates in a strap fastener 24. Strap fastener 24 may be any type of fastener capable of connecting the top of front panel 20 with strap 35. In a preferred embodiment, the strap fastener is a loop buckle 24 as shown in FIGS. 1 and 2. Strap 35 is threaded through slot 25 of buckle 24 and doubled back to a position on top of strap 35. Fastener 36 is matingly engaged to hold strap 35 in place and to hold front panel 20 across the user's chest 15. In a preferred embodiment, the strap fastener 36 is positioned to rest below the shoulder joint on the user's chest 15 for comfort.

As shown in FIG. 4, front panel 20 may also include a pocket 40 sized to fit a portable electronic device (PED) 42 such as a cell phone, personal digital assistant, pager, MP3 player, or the like. Pocket 40 includes a mouth 46 with a lip 41. Pocket 40 further includes a restraining strap 44 with a first end 45 having one of a pair of mating fasteners affixed thereto. The outer side 43 of pocket 40 includes the other of the pair of mating fasteners affixed thereto configured to fasten first end 45 to outer side 43. Restraining strap 44 is long enough to stretch over PEDs of varying height. In use, when PED 42 is placed in pocket 40 through mouth 46, restraining strap 44 is placed over the top of PED 42 and attached to outer side 43 of pocket 40. Strap 44 prevents PED 42 from falling out of pocket 43 when the user bends over or moves suddenly. In a preferred embodiment, restraining strap 44 and pocket 40 are positioned on front panel 20 below strap fastener 24.

FIG. 4 shows the position of restraining strap 44 in a closed position 47. Restraining strap 44 allows the user to quickly and confidently access PED 42. First end 45 disengages smoothly and rapidly from outer side 43 of pocket 40 thereby allowing easy access to PED 42. Restraining strap 44 keeps PED 42 securely in place so that the user does not worry about loss or damage to PED 42. The positioning of pocket 40 on front panel 20 also allows the vibration option of a PED to be used, such as on a cell phone, so that the user may easily feel through front panel 20 when a call is incoming because the vibration is felt on the chest and the ring is closer to the user's ears than in a traditional pants pocket.

It will be understood by those skilled in the art that, since certain changes may be made in the above invention without departing from the scope hereof, it is intended that all matter contained in the above description or shown in the accompanying drawings be interpreted as illustrative and not in a limiting sense. It is also to be understood that the following claims are to cover certain generic and specific features described herein.

The invention claimed is:

1. An overall configured to be worn over one shoulder comprising:

a. a pant portion;

b. a triangular front panel connected to the pant portion at a waistband, the front panel extending from the pant portion and terminating in a fastening means; and c. a triangular rear panel connected to the pant portion at a waistband, the rear panel extending from the pant portion and terminating in a fastening means, wherein the front and rear panels are connected by the fastening means;

d. wherein the rear and front panels are offset, each having a substantially vertical edge and an angled edge; and e. wherein the top point of each triangular panel is positioned to fit over only one of a user's shoulders.

2. The overalls of claim 1 wherein the front panel further includes a pocket for a portable electronic device.

3. The overalls of claim 2 wherein the front panel further includes a restraining strap that holds the portable electronic device in the pocket.

4. The overalls of claim 3 wherein the restraining strap is secured to the pocket by a hook and loop fastener.

5. The overalls of claim 1 wherein the pant portion includes a waist band.

6. The overalls of claim 5 wherein the waist portion further includes a cincher to vary the size of the waist band.

7. A garment configured to be worn over one shoulder comprising:

a. a pant portion with a right and left leg and a waistband;

b. a front panel with a substantially triangular shape with one side of the panel connected to the pant portion at a waistband and the opposite point of the panel forming a front strap that terminates in a buckle; and c. a rear panel with a substantially triangular shape with one side of the panel connected to the pant portion at a waistband and the opposite point of the panel forming a rear strap that is received by the buckle to secure the front and rear panels together;

d. wherein the rear and front panels are offset, each having a substantially vertical edge and an angled edge; and e. wherein the top point of each triangular panel is positioned to fit over only one of the user's shoulders.

8. The garment of claim 7 wherein the front panel further includes a pocket for a cell portable electronic device and an elongated restraining strap to hold a portable electronic device in the pocket.

9. The garment of claim 8 wherein the restraining strap is fastened by a hook and loop fastener.

10. The garment of claim 7 wherein the waistband includes a cincher to vary the size of the waistband.

* * * * *